US006583372B1

(12) United States Patent
Amonett

(10) Patent No.: US 6,583,372 B1
(45) Date of Patent: Jun. 24, 2003

(54) TIMER WITH TWO SPEED DELAY DRIVE SYSTEM

(75) Inventor: Daniel K. Amonett, Murfreesboro, TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 10/004,190

(22) Filed: Oct. 23, 2001

(51) Int. Cl.[7] ..... H01H 43/10
(52) U.S. Cl. ..... 200/38 R; 200/35 R
(58) Field of Search ..... 200/38 R, 38 C, 200/38 D, 38 CA, 35 R, 37 A; 74/122–125

(56) References Cited

U.S. PATENT DOCUMENTS

| | | | | |
|---|---|---|---|---|
| 4,153,824 A | | 5/1979 | Blackmond | 200/35 R |
| 4,381,433 A | | 4/1983 | Wagle | 200/38 R |
| 4,442,326 A | | 4/1984 | Wagle | 200/38 R |
| 4,484,040 A | | 11/1984 | Wagle | 200/38 R |
| 4,500,212 A | | 2/1985 | Wojtanek | 368/108 |
| 4,523,062 A | | 6/1985 | Mahon | 200/35 R |
| 4,525,609 A | | 6/1985 | Matsumoto et al. | 200/38 R |
| 4,536,627 A | | 8/1985 | Duve | 200/38 R |
| 4,551,590 A | | 11/1985 | Mahon | 200/38 R |
| 4,649,239 A | | 3/1987 | Duve | 200/38 R |
| 4,678,930 A | | 7/1987 | Mahon | 307/141 |
| 5,736,699 A | * | 4/1998 | Furlan et al. | 200/38 B |
| 6,080,943 A | * | 6/2000 | Amonett et al. | 200/38 B |

* cited by examiner

*Primary Examiner*—Karl D. Easthom
*Assistant Examiner*—M. Fishman
(74) *Attorney, Agent, or Firm*—Wood, Herron & Evans, L.L.P.

(57) ABSTRACT

A cam-operated timer 10 for a household appliance includes an interval type delay drive system to provide variable delay speeds to the rotation of a program cam. The timer 10 includes a rotatable cam-carrying member 16 having a control profile 60 of teeth and plateaus. A rotatable delay wheel 18 also includes a series of delay teeth 73 with at least one tooth 76 being of substantially greater depth than the remaining standard delay teeth 74. A delay pawl 22 is operatively connected to the drive mechanism of the timer 10 and includes at least first and second prongs 80, 82 spaced approximately the distance between the cam-carrying member 16 and the delay wheel 18, with the first prong 80 being substantially shorter than the second prong 82.

30 Claims, 9 Drawing Sheets

TIMER WITH TWO SPEED DELAY DRIVE SYSTEM

FIELD OF THE INVENTION

The present invention relates to cam-operated timers for appliances.

BACKGROUND OF THE INVENTION

Many household appliances are equipped with mechanical timers to control their operation. Examples include dishwashers, icemakers, clotheswashers and dryers, wall and outlet timers, microwave ovens, and various other appliances.

While there is thus a diverse variety of applications for timers, most timers have a similar general structure. Typically, the timer includes a wheel or drum outfitted with cam surfaces. Spring metal switch arms are mounted to ride on these cam surfaces to be raised and lowered from the wheel or drum surface in response to the elevation of the cam surfaces.

A timing motor is typically coupled to rotate the cam wheel or drum, such that the switch arms are raised or lowered in accordance with a predefined regular pattern that is defined by the elevation of the cam surfaces on the wheel or drum. In some timers, the timing motor moves the wheel or drum by causing drive pawls to oscillate and move the cam wheel or drum forward in a step-by-step fashion. Such a drive system is referred to as an "interval type program drive system". In other timers, the timing motor is connected through a gear train to a toothed surface on the cam wheel or drum to rotate the cam wheel or drum in a continuous manner. Such a drive system is referred to as a "constant speed program drive system".

The appliance operator typically sets the timer using a knob that extends outside of the timer housing and can be grasped by the operator. In a typical clotheswasher timer, for example, the operator rotates the knob in a forward direction, thereby rotating the cam wheel or drum in a forward direction, until the cam wheel or drum is an appropriate initial position to begin a timed operation cycle. The user then presses a button, or moves the knob axially to initiate the cycle and also start the timing motor.

Often, it may be necessary to slow the rotation of the cam wheel or drum during operation of the appliance. When such a delay is desirable, timers may be provided having delay mechanisms in order to halt or reduce the speed of the appliance functions being controlled by the timer. There exist various mechanisms for inducing such delay. For instance, some timers include a separate delay wheel that cooperatively functions with the cam wheel. An example of such a timer may be found in U.S. Pat. No. 4,153,824.

U.S. Pat. No. 4,153,824 discloses a rotary control timer for an automatic appliance, such as a washing machine, being driven by an interval type drive system including a saddle pawl connected to an element of the appliance that continuously oscillates or makes other repeated cycles of movement. Prongs on the pawl engage a plurality of peripherally toothed wheels, one of which is connected to the timer cam drum and another of which is free to rotate relative to the cam drum such that one pawl prong continually engages the free rotation wheel while a second pawl prong continually engages the drum connected wheel only intermittently. One tooth on the freely rotatable wheel has a depth approximately three times deeper than the remaining teeth. The actuating pawl has two prongs side by side with the prong associated with the freely rotatable wheel being about three times longer than the prong associated with the fixed wheel. As the longer prong bottoms in each tooth of the freely rotatable wheel, the shorter prong will ride freely above the fixed wheel until the deep tooth on the freely rotatable wheel is reached. At that time both prongs will drop into the teeth of their respective wheels and the pawl will advance both wheels one segment, thus advancing the timer drum connected to the fixed wheel one increment. As a result of this configuration, the timer of U.S. Pat. No. 4,153,824 slows the rotation of the cam drum because the wheel connected to the timer cam will only advance one tooth for each complete rotation of the wheel freely rotatable about the timer shaft.

However, certain drawbacks exist in the timer of the '824 patent. For example, the rotational period of the timer can be delayed only at one delay speed. It does not provide for delays of varying lengths for the rotation of the cam drum. Further, it does not provide for accelerating the rotation of the cam drum. In many appliances, it would be desirable to have variable speeds of delay or acceleration for certain functions.

SUMMARY OF THE INVENTION

In accordance with the principles of the present invention, the drawbacks and difficulties with known cam-operated timers, described above in the background of the invention, are overcome.

In a first embodiment, the present invention features a cam-operated timer having a delay wheel which provides two speeds of a timing delay. In a second embodiment, the timer of the present invention provides for rapid advance of the program cam.

The timer of the present invention includes two drive systems: (1) an interval type delay drive system that is designed to be used with (2) a constant speed program drive system. The interval type delay system drives a delay wheel, and the constant speed program drive system drives the program cam. However, in alternate embodiments of the invention, the interval type delay drive system could also be used with a timer having an interval type program drive system. As mentioned above, the timer of the present invention provides at least two different delay timings. One delay period could be used for a delay to start, where a long delay interval is desired, and the other delay period could be used for an in-cycle delay, where a shorter delay is desired. It will be apparent to those skilled in the art that the delay drive system of the present invention is not limited to two delay periods, but may be adapted for any number of delay periods.

The timer of the present invention includes a rotatable cam carrying member having cam surfaces thereon, and further including a control profile disposed about its periphery including a plurality of teeth and a plurality of plateaus. The timer further includes a rotatable delay wheel having a series of teeth substantially equidistantly spaced one from another, disposed about the periphery of the delay wheel, with at least one of those teeth being of greater depth than the remaining teeth which exhibit a substantially uniform depth. The cam carrying member is fixedly mounted to a shaft. The delay wheel is also located on the shaft, but is freely rotatable about the shaft. The cam carrying member and the delay wheel are rotatably located adjacent one another on the shaft. The timer further includes a constant speed program drive system including a timing motor having a rotor that rotates in response to electrical stimulation and a drive mechanism for causing rotation of the cam carrying member in response to rotation of the rotor. This drive mechanism includes a geartrain having a series of cooperating gears and pinions. Finally, the timer includes a delay pawl which is operatively connected to the drive mechanism. This delay pawl includes first and second prongs spaced such that the first prong cooperates with the cam carrying member and the second prong cooperates with the delay wheel. The first prong is shorter than the second prong.

There are three modes of operation of the timer of the present invention: (1) normal non-delay advancement of the program cam, (2) in-cycle delay advancement, and (3) delay to start timing.

Normal non-delay advancement of the program cam is achieved by the geartrain of the constant speed program drive system. The final output pinion of the drive mechanism engages gear teeth located about the periphery of the program cam in order to advance the program cam. During this mode, the delay pawl is oscillating, but the first prong is riding on a plateau formed by the top radius of the control profile of the program cam, preventing either the first or second prongs of the delay pawl from engaging a rachet tooth on either the cam carrying member or the delay wheel.

As the program cam advances, it rotates into a location requiring in-cycle delay. The delay pawl tip drops off the top radius of the control profile of the cam carrying member during the retraction stroke of the pawl and engages an upper level rachet tooth on the delay wheel. As this occurs, the program cam is advanced into an area having no teeth on the periphery of the program cam to engage with the final output pinion. Thus, the output pinion no longer drives the program cam and the delay wheel is only advanced one tooth by the delay pawl. As the delay pawl continues to oscillate, it will continue advancing the delay wheel one tooth per oscillation. However, since the upper level rachet tooth on the delay wheel will not permit the pawl tip to engage the intermediate level rachet tooth on the program cam, the program cam is not advanced. When the delay pawl drops into either an intermediate tooth or a deep tooth on the delay wheel, it will engage the intermediate tooth on the program cam and advance the program cam one step. When the last step of in-cycle delay is advanced, the program cam is advanced so the gear teeth on its periphery once again engage with the final output pinion and the delay pawl tip is once again lifted onto the top radius of the control profile. At this point, the normal constant speed drive system will take over program cam advancement.

As the program cam advances, it rotates into a location requiring a delay-to-start timing period. The delay pawl drops off the top radius of the control profile of the cam-carrying member during the retraction stroke of the pawl and engages an upper level rachet tooth on the delay wheel. As this occurs, the program cam is advanced into an area having no teeth on the periphery of the cam-carrying member to engage with the final output pinion. Thus, as the delay pawl oscillates forward in the drive stroke, it advances the delay wheel one tooth. As the delay pawl continues to oscillate, it will continue advancing the delay wheel one tooth per oscillation. However, since the upper level rachet tooth on the delay wheel will not permit the paw tip to engage the lower level rachet tooth on the program cam, the program cam is not advanced. An intermediate tooth on the delay wheel will also not permit the pawl tip to engage the lower level rachet tooth on the program cam. When the delay pawl drops into a deep tooth on the delay wheel, it will engage the deep tooth on the program cam and advance the program cam one step. When the last step of delay to start is advanced, the program cam is advanced, the program cam is advanced so that gear teeth on its periphery once again engage the final output pinion and the delay pawl is once again lifted onto a top radius of the control profile. At this point, normal constant speed drive system will take over program cam advancement.

The timer of the present invention also includes a no-back pawl which prevents the cam from being turned backwards when the system is in delay mode. When the constant speed drive pinion is engaged with the gear teeth on the cam, a clutch in the drivetrain of the pinion prevents reverse rotation of the cam. However, in delay mode, the pinion teeth are not engaged with the gear teeth. Thus, the no-back pawl engages with pockets in the back of the cam to prevent reverse rotation of the cam. The no-back pawl is attached to a fixed location in the front housing of the timer.

When used with the constant speed program drive system, an alternate embodiment of the timer of the present invention provides for rapid advance of the cam-carrying member. In this embodiment, the top radius on the control profile is replaced with a top level rachet tooth, permitting the program cam to be advanced at an accelerated rate.

Other features and advantages of the present invention will become apparent from the following detailed description, taken in conjunction with the accompanying drawings which illustrate, by way of example, the features of the invention.

DETAILED DESCRIPTION

Figure 1A:
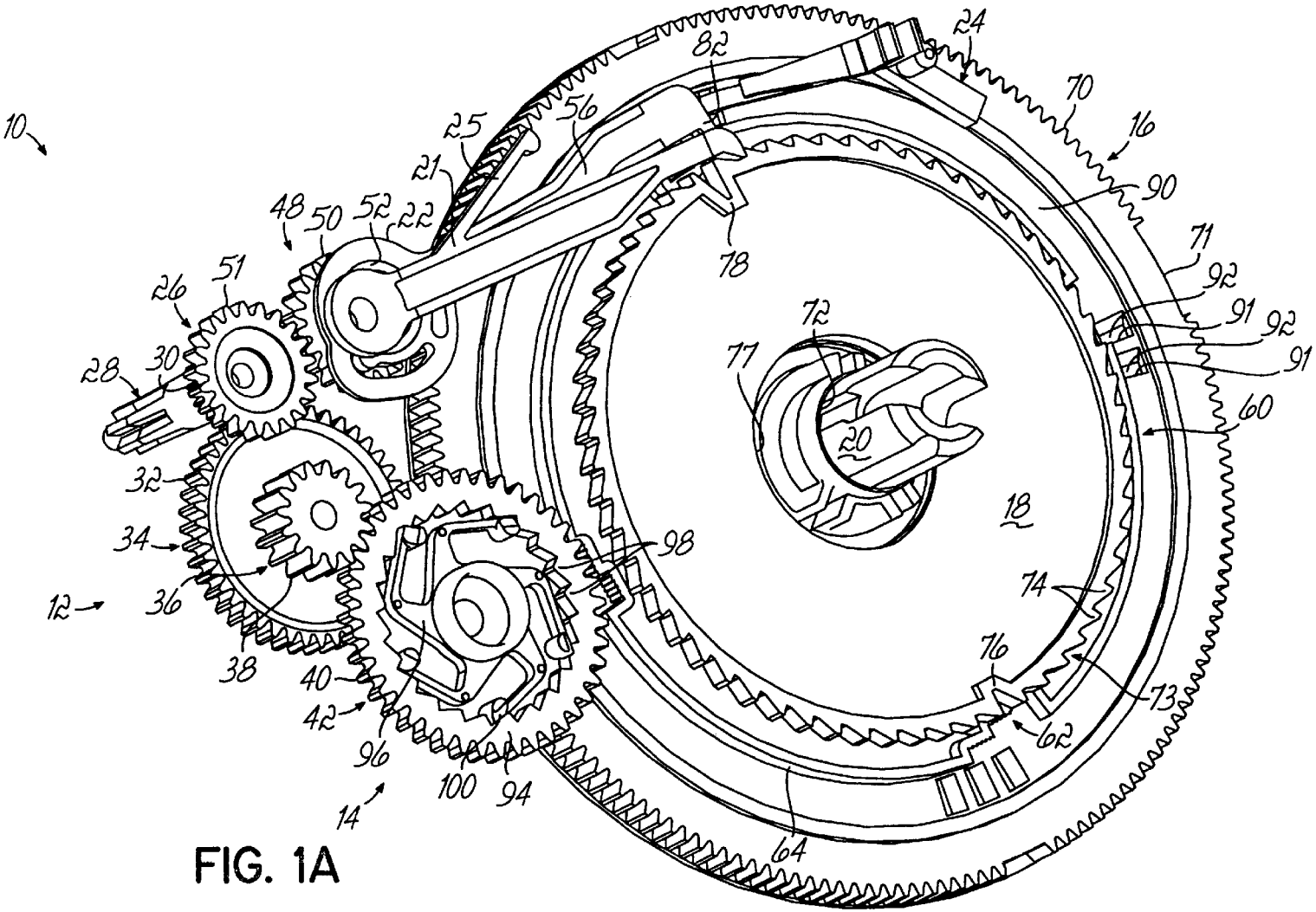
FIG. 1A is a perspective view depicting the cam-carrying member, delay wheel, delay pawl, and geartrain of the timer of the present invention.

The present invention avoids the drawbacks and solves the problems discussed in the background of the invention above. As shown in FIG. 1A, the present invention provides a cam-operated timer 10 including a geartrain 12, a one-way clutch mechanism 14, a rotatable cam-carrying member 16, a rotatable delay wheel 18, a shaft 20 to which the cam-carrying member 16 is fixedly mounted and about which the delay wheel 18 is freely rotatable, a delay no-back pawl 21 to prevent reverse rotation of the delay wheel 18, a delay pawl 22 operatively connected to the geartrain 12, and a cam no-back pawl 24 to prevent reverse rotation of the rotatable cam-carrying member 16 when the timer 10 is in a delay mode.

More specifically and with reference to FIGS. 1A, 1B, 2, and 3, in the illustrated embodiment, the present invention features a cam-operated timer 10 having a delay wheel 18 which provides two different timing delay speeds. For example, one timing could be used for a "delay to start" timing period, where a very long delay interval is desired, and the other timing could be used for an "in-cycle delay", where a much shorter delay timing is desired. In an alternate embodiment (FIG. 8), the timer 10 of the present invention provides for rapid advance of the rotatable cam-carrying member 16. This advance is possible any time the rotatable cam-carrying member 16 is not engaged in an in-cycle delay or a delay to start mode.

The timer 10 of the present invention includes two drive systems: (1) an interval type delay drive system that is designed to be used with (2) a constant speed program drive system. The interval type delay system uses the delay pawl 22 to drive the delay wheel 18. It does so by advancing the delay wheel 18 by one tooth for each reciprocal movement of the delay pawl 22. This advance occurs only when the constant speed program drive system is disengaged.

The constant speed program drive system includes a timing motor (not shown) and geartrain 12 assembly and drives the rotatable cam-carrying member 16 when the timer 10 is not in a delay mode. The geartrain 12 includes a plurality of gears and pinions. Each gear and each pinion includes, respectively, a plurality of gear teeth or pinion teeth disposed about its periphery. The gear teeth of each gear are meshed with the pinion teeth of a pinion and the pinion teeth of each pinion are likewise meshed with the gear teeth of the next succeeding gear, with the exception of the final stage pinion which has pinion teeth that mesh with teeth disposed about the periphery of the rotatable cam-carrying member 16. For example, in the geartrain 12 of the illustrated embodiment depicted in FIGS. 1A and 1B including three gears and three pinions, the first stage pinion 26 would be rotated by a timing motor (not shown). The first stage pinion shaft 28 would rotate cooperatively with the first stage pinion 26. The pinion teeth 30 disposed about the periphery of the first stage pinion shaft 28 would mesh with the gear teeth 32 of the second stage gear 34, thus driving the rotation of the second stage gear 34. The second stage pinion 36 would rotate cooperatively with the second stage gear 34. The pinion teeth 38 disposed about the periphery of the second stage pinion 36 mesh with the gear teeth 40 of the third stage gear 42, thus driving the rotation of the third stage gear 42. The third stage pinion 44 rotates cooperatively with the third stage gear 42 and includes pinion teeth 46 disposed about its periphery that engage teeth on the rotatable cam-carrying member 16, thereby driving the rotation of the rotatable cam-carrying member 16. It will be recognized by those having skill in the art that any number of gears and pinions may be included in the drive mechanism of the timer 10 of the present invention.

In each of various embodiments having any number of gears and pinions, a timing motor drives the initial gear. The pinion cooperatively associated with the initial gear is driven by rotation of the initial gear. This rotational drive proceeds down the geartrain 12 to the final stage pinion, the rotation of which drives the rotation of the rotatable cam-carrying member 16.

The geartrain 12 of the illustrated embodiment further includes an intermediate gear 48 which drives the delay pawl 22. This intermediate gear 48 includes gear teeth 50 which mesh with the pinion teeth 51 of the first stage pinion 26. As the first stage pinion 26 rotates, it drives rotation of the intermediate gear 48. The intermediate gear 48 rotates cooperatively with an eccentric cam 52 which is disposed through an orifice 54 in the distal end of a lever arm 56 of the delay pawl 22. Rotation of the intermediate gear 48 and eccentric cam 52 causes oscillation of the delay pawl 22.

In an alternate embodiment of the present invention, the interval type delay drive system could also be used with a timer 10 having an interval type program drive system. In this embodiment, any constant speed gear and pinion drive structure would be eliminated and the delay pawl 22 would be the only drive mechanism. Normal program cam advance would be accomplished by replacing the top radius of the rotatable cam-carrying member 16 with an upper level tooth. The final pinion of the geartrain 12 would be pinion 26. As the pinion 26 rotates, the pinion teeth mesh with gear teeth 50 of intermediate gear 48 causing eccentric cam 52 to rotate and oscillate the delay pawl 22. A first prong 80 of the delay pawl 22 would engage one upper level tooth with each oscillation of the delay pawl 22, resulting in rotation of the rotatable cam-carrying member 16.

As mentioned above, the timer 10 of the present invention provides at least two different delay timings. One delay period could be used for a delay to start, where a long delay interval is desired, and the other delay period could be used for an in-cycle delay, where a shorter delay is desired. It will be apparent to those skilled in the art from the description herein that the delay drive system of the present invention is not limited to two delay periods, but may be adapted for any number of delay periods.

Figure 1B:
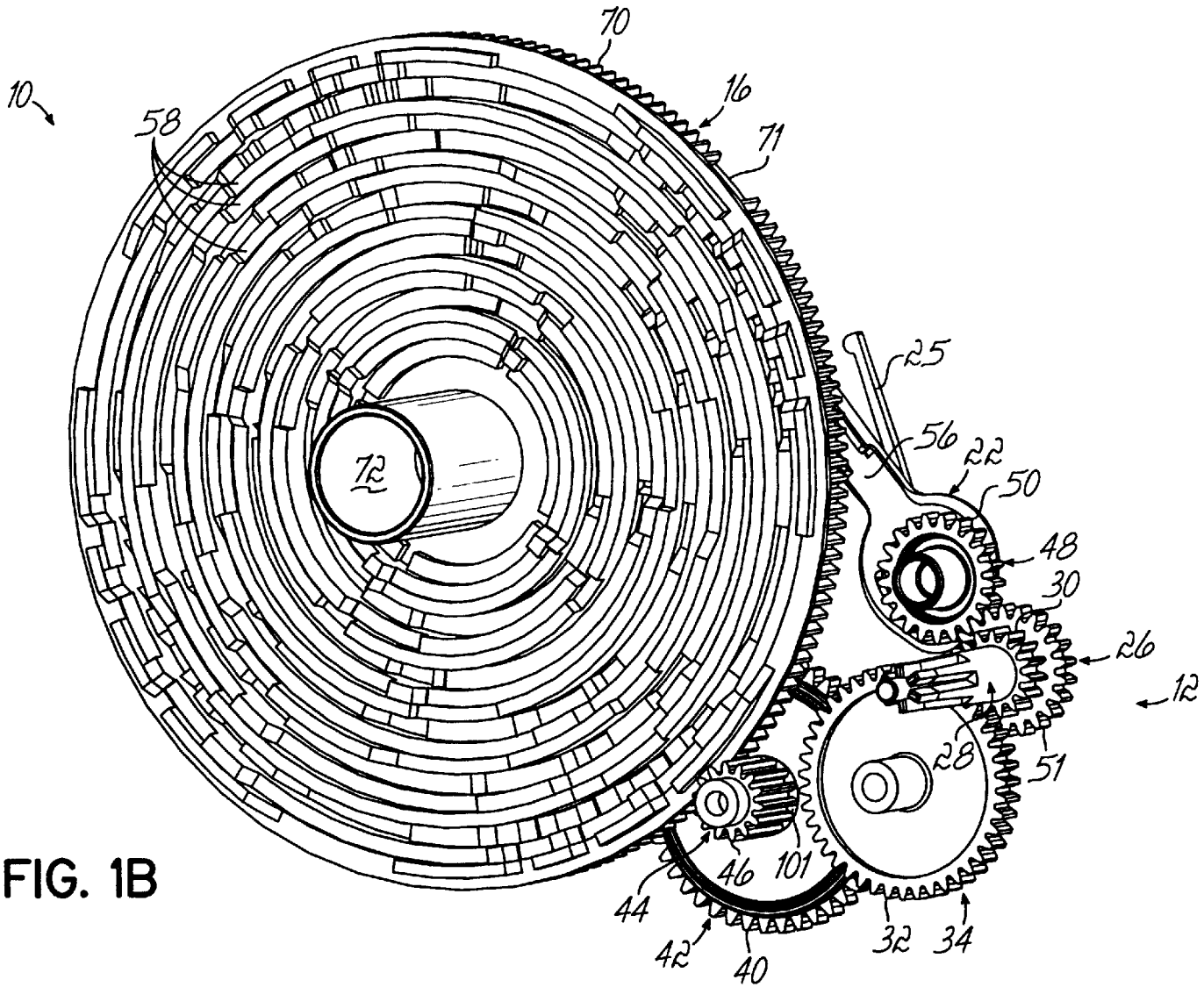
FIG. 1B is a perspective view depicting the cam-carrying member and geartrain of the timer of the present invention.
Figure 2:
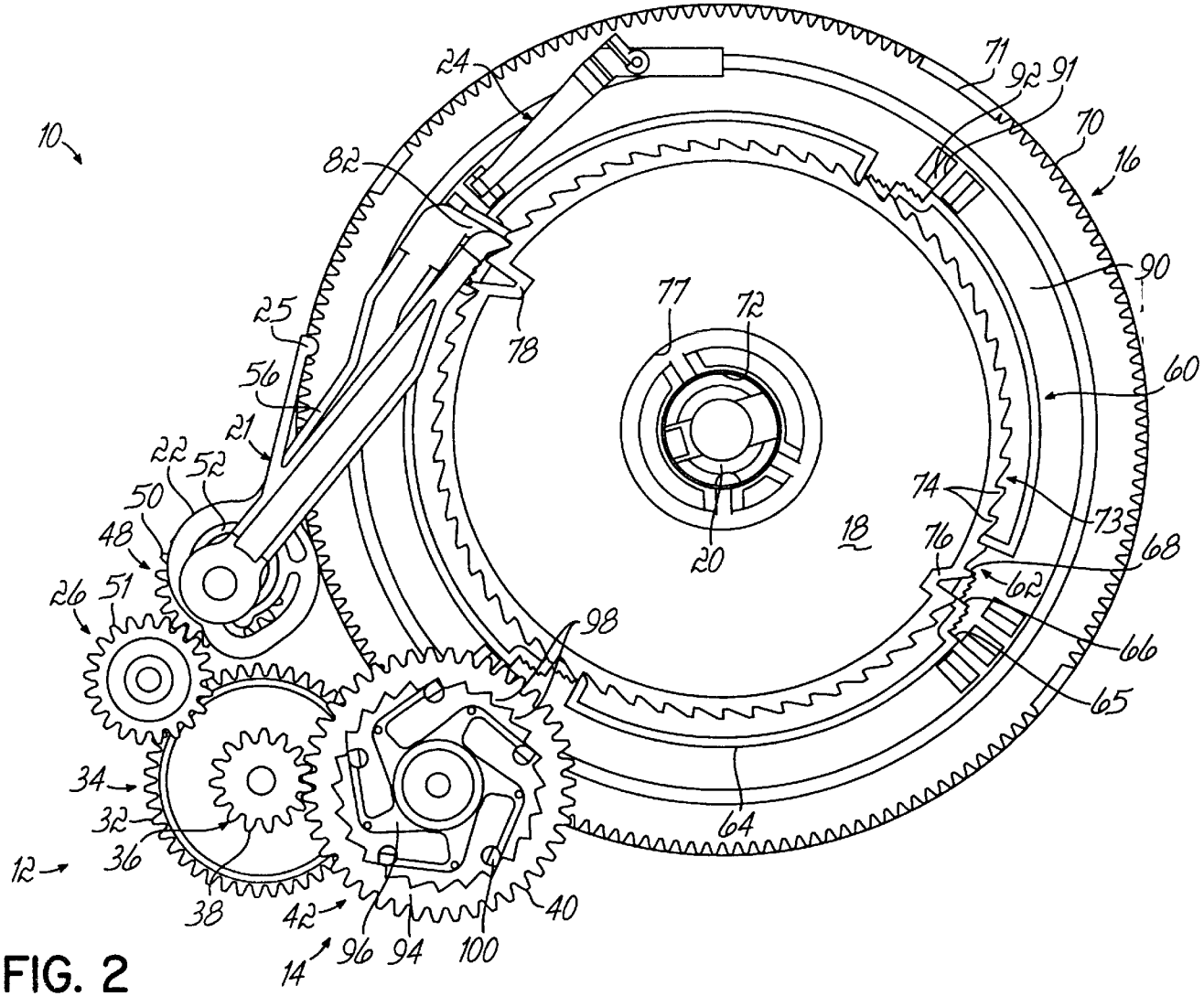
FIG. 2 is a top view of the timer of the present invention.
Figure 7:
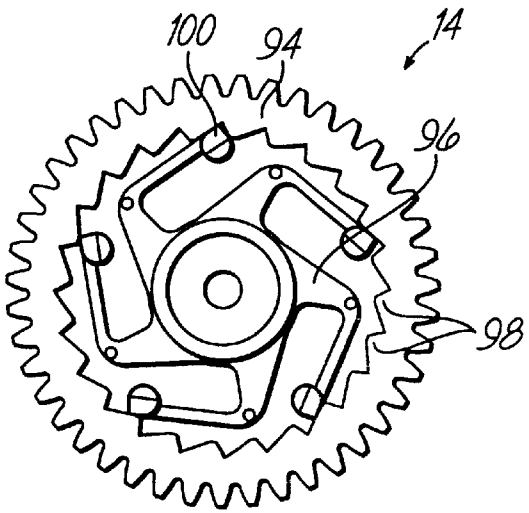
FIG. 7 is a perspective view of the clutch of the timer of the present invention.
Figure 3:
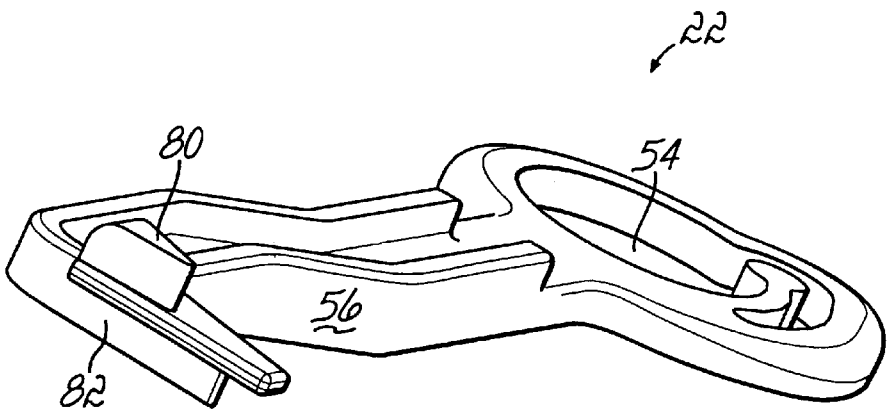
FIG. 3 is a perspective view of the delay pawl of the present invention.

Referring to FIGS. 1A, 1B, and 2, the rotatable cam-carrying member 16 of the timer 10 of the illustrated embodiment of the present invention has a plurality of cam surfaces 58 disposed thereon, and further includes a control profile 60 disposed thereon. In the illustrated embodiment of the invention, this control profile 60 includes a plurality of profile teeth 62 and a plurality of plateaus 64. The plurality of profile teeth 62 include starting level teeth 65, intermediate level teeth 66 and lower level teeth 68. The starting level teeth 65, intermediate level teeth 66 and lower level teeth 68 are substantially equidistantly spaced equivalent to the spacing of teeth on the periphery of the delay wheel 18. The starting level teeth 65, intermediate level teeth 66 and lower level teeth 68 are substantially equal in depth, one to another.

Additionally, the rotatable cam-carrying member 16 includes a plurality of peripheral gear teeth 70 disposed about its outer circumference which engage the pinion teeth 46 of the final output pinion 44 of the geartrain 12. The series of successive peripheral gear teeth 70 is interrupted intermittently by spaces 71 along the outer circumference of the rotatable cam-carrying member 16 which exhibit no teeth. As described above, the pinion teeth 46 of the final output pinion 44 engage the peripheral gear teeth 70 of the rotatable cam-carrying member 16 to drive rotation of the rotatable cam-carrying member 16. However, when engagement of the peripheral gear teeth 70 by pinion teeth is interrupted by a space 71, the constant drive system is interrupted, and the interval type delay drive system of the delay wheel 18 and delay pawl 22 takes over the drive mechanism of the timer 10.

The rotatable cam-carrying member 16 further has a bore 72 to fix the cam-carrying member 16 on the shaft 20 of the timer 10. This bore 72 is disposed through the rotatable cam-carrying member 16 substantially along the axis of symmetry of the rotatable cam-carrying member 16. The shaft 20 of the timer 10 is disposed through this bore 72 and the rotatable cam-carrying member 16 is journalled to the shaft 20 such that the rotatable cam-carrying member 16 and the shaft 20 rotate cooperatively.

The timer 10 of the present invention further includes a rotatable delay wheel 18 having a series of delay teeth 73 substantially equidistantly spaced one from another, and disposed about the periphery of the delay wheel 18, with at least one delay tooth being of greater depth than the remaining standard delay teeth 74 which exhibit a substantially uniform depth. There is a central bore 77 through the delay wheel 18, located substantially along the axis of symmetry of the delay wheel 18, and sized such that the delay wheel 18 will revolve smoothly about a bearing (not shown) in the front housing (not shown) of the timer. Thus, the delay wheel 18 is freely rotatable about the shaft 20. The rotatable cam-carrying member 16 and the delay wheel 18 are rotatably located adjacent one another inside the timer housing (not shown).

More specifically, in the first embodiment of the present invention, the delay wheel 18 includes an intermediate delay tooth 76 of greater depth than the substantially uniform depth of the remaining standard delay teeth 74 and also includes a deep delay tooth 78 of greater depth than the substantially uniform depth of the remaining delay teeth 74. This deep delay tooth 78 is also of a greater depth than the depth of the intermediate delay tooth 76.

Additionally, and referring to FIGS. 1A–3, the timer 10 of the present invention includes a delay pawl 22 which is operatively connected to the geartrain 12. The delay pawl 22 includes first and second prongs 80, 82 spaced such that the first prong 80 cooperates with and is adapted to confront the starting level teeth 65, intermediate level teeth 66, lower level teeth 68, and plateaus 64 of the control profile 60 of the rotatable cam-carrying member 16 and the second prong 82 cooperates with and is adapted to confront the standard delay teeth 74, intermediate delay teeth 76, and deep delay teeth 78 of the delay wheel 18. In the first embodiment of the present invention, the first prong 80 is shorter in length than the second prong 82. The delay pawl 22 further comprises a lever arm 56 having the first and second prongs 80, 82 disposed at one end and further having an orifice 54 in an end distal to the first and second prongs 80, 82. The eccentric cam 52 is disposed through this orifice 54 so the delay pawl 22 oscillates cooperatively with the drive supplied by the geartrain 12 of the timer 10.

In use, there are three modes of operation of the timer 10 of the illustrated embodiment of the present invention: (1) normal non-delay advancement of the rotatable cam-carrying member 16, (2) in-cycle delay advancement of the rotatable cam-carrying member 16, and (3) delay-to-start timing advancement of the rotatable cam-carrying member 16. During normal non-delay advancement, the rotatable cam-carrying member 16 is driven by the constant speed geartrain 12 drive mechanism as described above. However, in the other two modes of operation, the delay pawl 22 is used to drive the rotatable cam-carrying member 16.

In both in-cycle delay advancement and delay-to-start advancement of the rotatable cam-carrying member 16, the constant speed geartrain 12 is disengaged from the rotatable cam-carrying member 16 and the delay wheel 18 is advanced tooth by tooth due to the reciprocation of the delay pawl 22. With each reciprocation of the delay pawl 22, the second prong 82 of the delay pawl 22 will engage one of the standard delay teeth 74 of the delay wheel 18. However, the first prong 80, being shorter than the second prong 82, will not engage any teeth of the rotatable cam-carrying member 16. On return of the delay pawl 22 toward its apogee, the second prong 82 will ramp up the next succeeding standard delay tooth 74 of the delay wheel 18, then engage the standard delay tooth 74 and advance the delay wheel 18 one increment as the pawl descends with the lever arm 56. This operation continues with each successive delay tooth 73 on the delay wheel 18 until the second prong 82 engages a delay tooth 76 on the delay wheel 18 of greater depth than the remaining, substantially uniform standard delay teeth 74. At this time, the first prong 80 may engage a tooth of the rotatable cam-carrying member 16 to advance the rotatable cam-carrying member 16 one increment with the delay wheel 18. On the next reciprocation, the second prong 82 will then engage one of the remaining substantially uniform standard delay teeth 74 and the first prong 80 will again remain out of contact with the rotatable cam-carrying member 16.

Additionally, the delay wheel 18 may include an intermediate delay tooth 76. When this intermediate delay tooth 76 is engaged by the second prong 82, the first prong 80 either may or may not engage the rotatable cam-carrying member 16. This aspect of the invention will be discussed in greater detail below. In other embodiments of the invention, more than two delay teeth of greater depth than the substantially uniform remaining delay teeth 74 may be used in order to create varied timing outputs for the timer 10. Additionally, delay teeth 73 of different depths can be used to create different timing delays, which will be described in greater detail below.

As described above, a first embodiment of the timer 10 of the resent invention includes the following operating modes: (1) normal non-delay advancement, (2) in-cycle delay, and (3) delay to start.

Referring now to FIGS. 1A, 1B, 2, and 4A, normal non-delay advancement of the rotatable cam-carrying member 16 is achieved by the geartrain 12 of the constant speed program drive mechanism. The pinion teeth 46 of the final output pinion 44 of the geartrain 12 engage peripheral gear teeth 70 located about the outer circumference of the rotatable cam-carrying member 16 in order to advance the rotatable cam-carrying member 16. During this mode, the delay pawl 22 is oscillating due to the geartrain 12 of the drive mechanism. However, the first prong 80 of the delay pawl 22 rides on a plateau 64 formed by the top radius of the control profile 60 of the rotatable cam-carrying member 16, preventing the first prong 80 of the delay pawl 22 from engaging either an intermediate level tooth 66 or a lower level tooth 68 on the control profile 60 of the rotatable cam-carrying member 16. When the first prong 80 is in this position, the second prong 82 of the delay pawl 22 is also prevented from engaging a tooth 73 on the delay wheel 18.

Figure 4B:
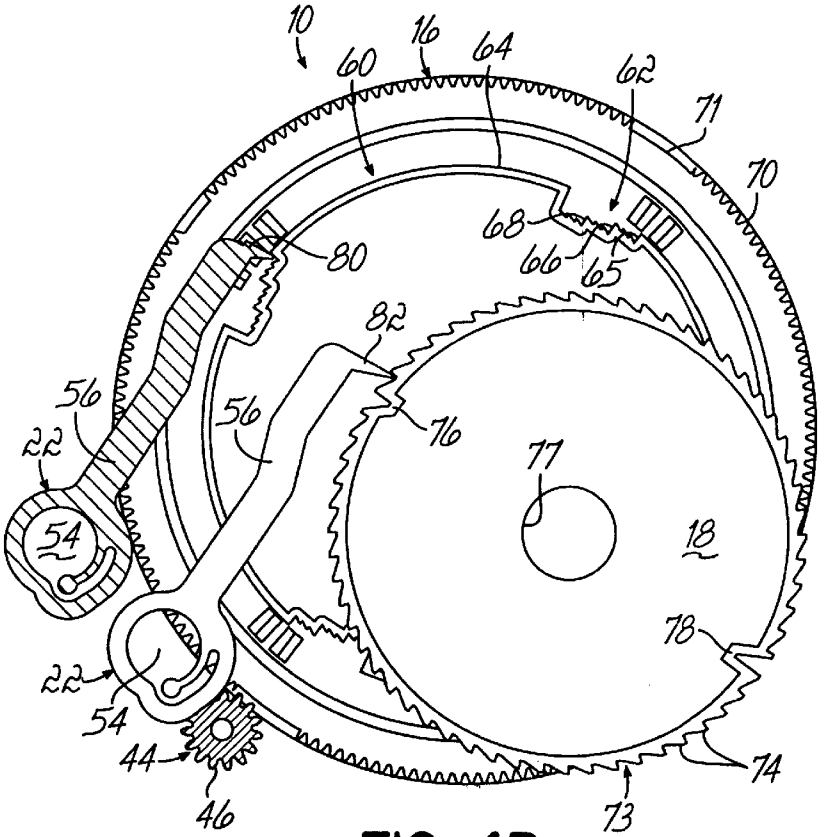
FIG. 4B is a separated cross-section of the timer of the present invention in an in-cycle delay, depicting the second prong engaging an upper level ratchet tooth on the delay wheel.

As the rotatable cam-carrying member 16 advances, it rotates into a location requiring in-cycle delay. Referring now to FIGS. 4A–4D, the first prong 80 of the delay pawl 22 drops off the plateau 64 of the top radius of the control profile 60 of the rotatable cam-carrying member 16 during the retraction stroke of the delay pawl 22 (FIG. 4B). In this position, the second prong 82 on the delay pawl 22 also drops and engages a standard delay tooth 74 on the delay wheel 18. During the drive stroke of the delay pawl 22, the rotatable cam-carrying member 16 is advanced by the first prong 80 of the delay pawl 22 engaging the start level tooth 65, into a space 71 having no teeth on the periphery of the rotatable cam-carrying member 16 to engage with the pinion teeth 46 of the final output pinion 44. Thus, the final output pinion 44 and geartrain 12 no longer drive the rotatable cam-carrying member 16 and the delay wheel 18 is only advanced one delay tooth 73 per oscillation of the delay pawl 22.

Referring to FIG. 4B, as the delay pawl 22 continues to oscillate, it will continue advancing the delay wheel 18 by one delay tooth 73 per oscillation. However, as the second prong 82 engages the standard delay teeth 74 on the delay wheel 18 the first prong 80 of the delay pawl 22 is prevented from engaging any intermediate level teeth 66 on the rotatable cam-carrying member 16. Thus, the rotatable cam-carrying member 16 is not advanced.

Figure 4A:
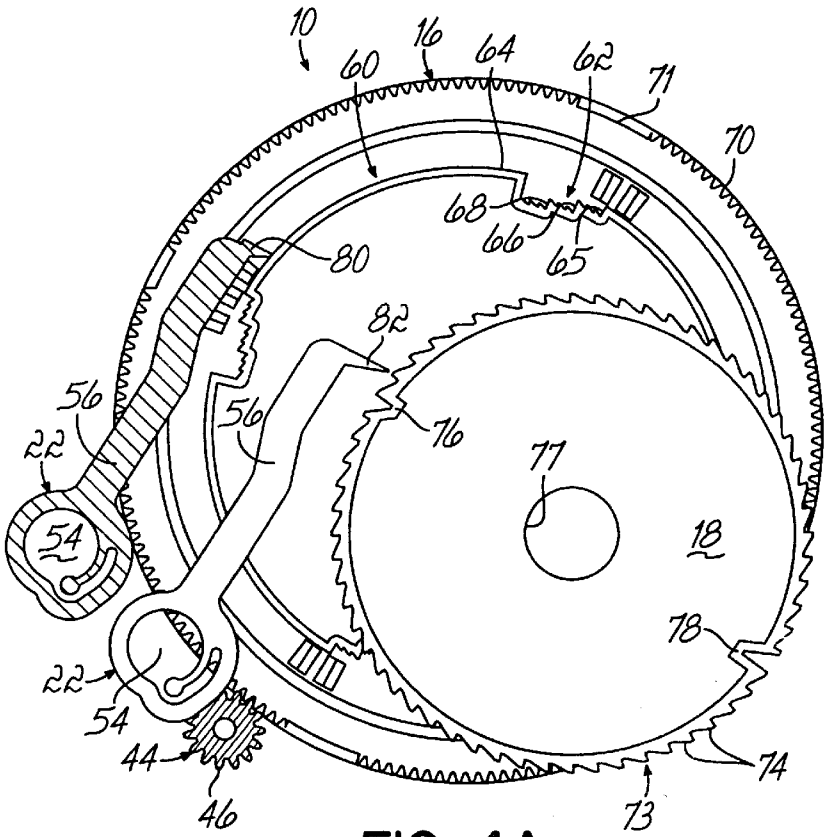
FIG. 4A is a separated cross-section of the timer of the present invention depicting the first prong of the delay pawl on the top radius of the control profile in accordance with the principles of the present invention.
Figure 4D:
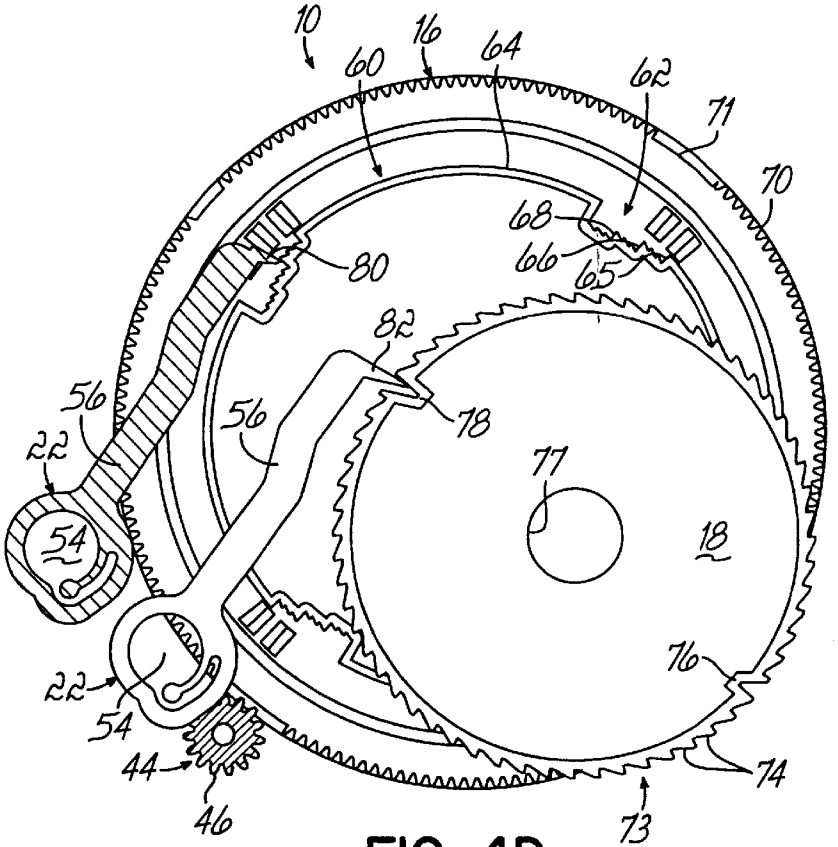
FIG. 4D is a separated cross-section of the timer of the present invention in in-cycle delay, depicting the second prong engaging a deep tooth on the delay wheel and the first prong engaging an intermediate tooth on the cam-carrying member.
Figure 4C:
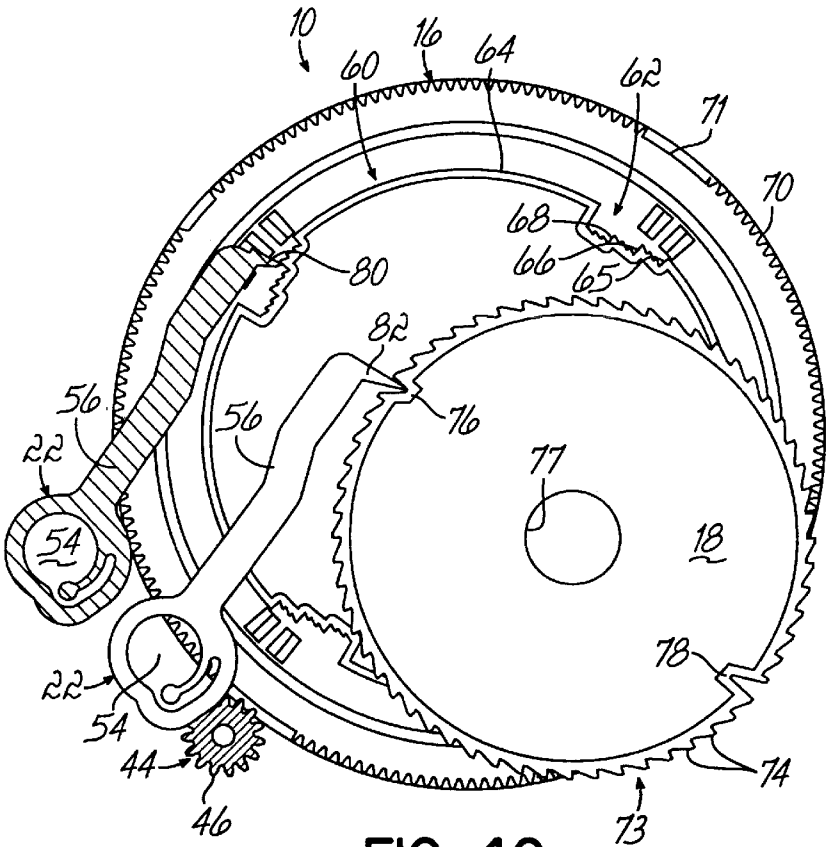
FIG. 4C is a separated cross-section of the timer of the present invention in an in-cycle delay, depicting the first and second prongs engaging intermediate teeth on the cam-carrying member and delay wheel respectively.

Referring to FIG. 4C, when the second prong 82 of the delay pawl 22 drops into an intermediate delay tooth 76 on the delay wheel 18, the first prong 80 will engage an intermediate level tooth 66 on the rotatable cam-carrying member 16 and advance the rotatable cam-carrying member 16 one step. After advancing the rotatable cam-carrying member 16 one step, in the first embodiment of the invention, the second prong 82 of the delay pawl 22 returns to engaging a standard delay tooth 74 of the delay wheel 18 on its next oscillation, as in FIG. 4B. At this point, the first prong 80 is prevented from engaging an intermediate level tooth 66 on the rotatable cam-carrying member 16, and thus, the rotatable cam-carrying member 16 is not advanced (FIG. 4B).

Referring to FIG. 4D, when the second prong 82 of the delay pawl 22 drops into a deep delay tooth 78 on the delay wheel 18, the first prong 80 will engage an intermediate level tooth 66 on the rotatable cam-carrying member 16 and advance the rotatable cam-carrying member 16 one step. After advancing the rotatable cam-carrying member 16 one step, in the first embodiment of the invention, the second prong 82 of the delay pawl 22 returns to engaging a standard delay tooth 74 of the delay wheel 18 on its next oscillation, as in FIG. 4B. At this point, the first prong 80 is prevented from engaging an intermediate level tooth 66 on the rotatable cam-carrying member 16, and thus, the rotatable cam-carrying member 16 is not advanced (FIG. 4B).

When the last step of in-cycle delay is advanced, the rotatable cam-carrying member 16 is advanced so the peripheral gear teeth 70 disposed about the outer circumference of the rotatable cam-carrying member 16 once again engage with the pinion teeth 46 of the final output pinion 44 of the geartrain 12 and the first prong 80 of the delay pawl 22 is once again lifted onto the top radius of the control profile 60 of the rotatable cam-carrying member 16, as in FIG. 4A. At this point, the normal constant speed drive system will take over advancement of the rotatable cam-carrying member 16.

When the rotatable cam-carrying member 16 is rotated into a location requiring delay-to-start advancement, the outer circumference of the rotatable cam-carrying member 16 again has no peripheral gear teeth 70 to engage with the pinion teeth of the final output pinion of the geartrain 12. Referring to FIG. 5A, at this point, the first prong 80 of the delay pawl 22 will drop off the top radius of the control profile 60 of the rotatable cam-carrying member 16 and the second prong 82 will engage a standard delay tooth 74 on the delay wheel 18. During the drive stroke of the delay pawl 22, the rotatable cam-carrying member 16 is advanced by the first prong 80 of the delay pawl 22 engaging the start level tooth 65, into a space 71 having no gearteeth 70 on the periphery of the rotatable cam-carrying member 16. As the delay pawl 22 oscillates forward in the drive stroke, the second prong 82 engages a standard delay tooth 74 of the delay wheel 18 and advances the delay wheel 18 one tooth. As the delay pawl 22 continues to oscillate, it will continue advancing the delay wheel 18 one delay tooth 73 per oscillation. However, as the second prong 82 engages the standard delay teeth 74 on the delay wheel 18, the first prong 80 of the delay pawl 22 is prevented from engaging a lower level tooth 68 on the rotatable cam-carrying member 16. Thus, the rotatable cam-carrying member 16 is not advanced.

Figure 5B:
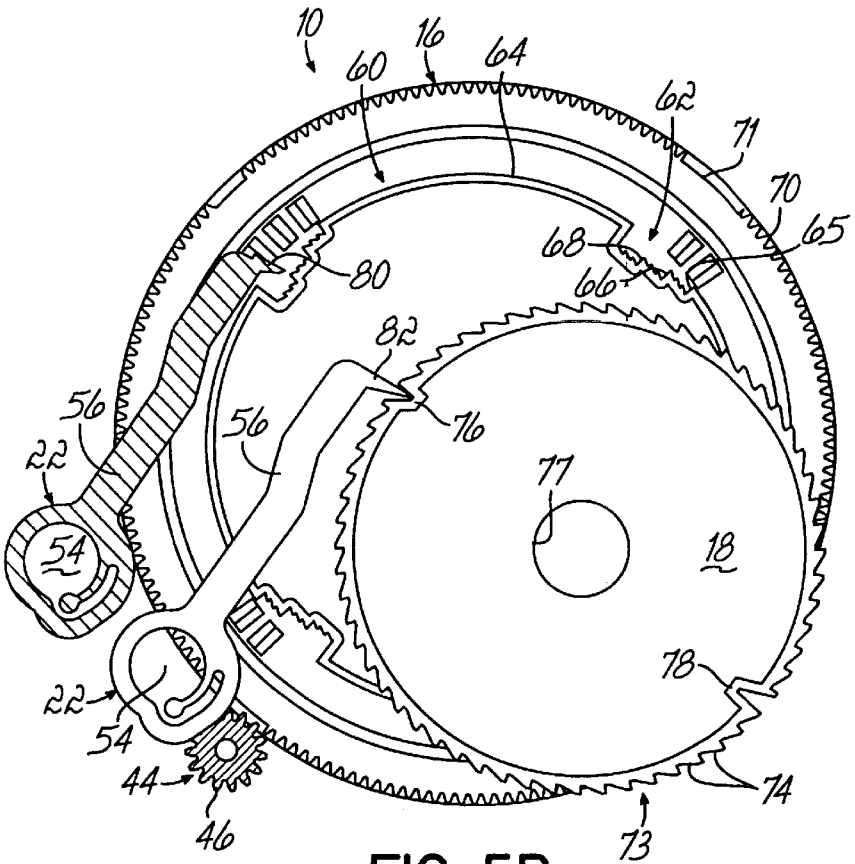
FIG. 5B is a separated cross-section of the timer of the present invention in delay to start, depicting the second prong engaging an intermediate level ratchet tooth of the delay wheel.
Figure 5A:
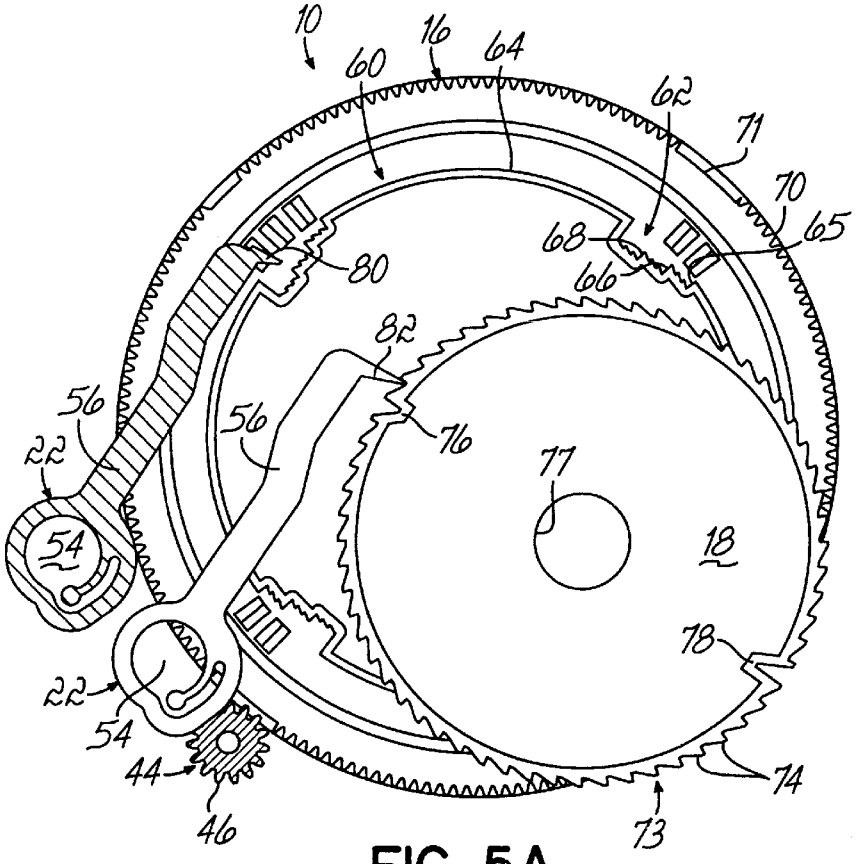
FIG. 5A is a separated cross-section of the present invention in delay to start, depicting the second prong engaging an upper level ratchet tooth of the delay wheel.
Figure 5C:
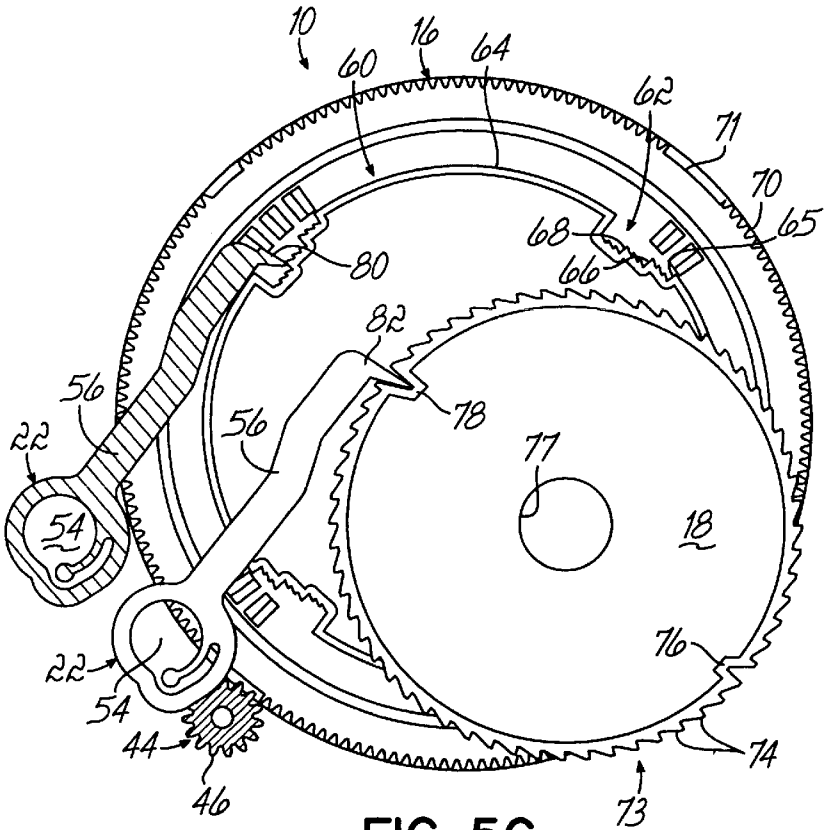
FIG. 5C is a separated cross-section of the timer of the present invention in delay to start, depicting the second prong engaging a deep tooth of the delay wheel and the first prong engaging a level ratchet tooth of the cam-carrying member.

Referring to FIG. 5B, when the second prong 82 drops into and engages an intermediate delay tooth 76 on the delay wheel 18, the first prong 80 of the delay pawl 22 does not engage a lower level tooth 68 on the rotatable cam-carrying member 16. However, referring to FIG. 5C, when the second prong 82 of the delay pawl 22 drops into and engages a deep delay tooth 78 on the delay wheel 18, the first prong 80 will engage a lower level tooth 68 on the rotatable cam-carrying member 16 and advance the rotatable cam-carrying member 16 one step.

When the last step of delay to start is advanced, the rotatable cam-carrying member 16 is advanced so that peripheral gear teeth 70 disposed about its outer circumference once again engage the pinion teeth 46 of the final output pinion 44 of the geartrain 12 and the first prong 80 of the delay pawl 22 is once again lifted onto a top radius of the control profile 60 of the rotatable cam-carrying member 16 as seen in FIG. 4A. At this point, normal constant speed drive system will take over advancement of the rotatable cam-carrying member 16.

Referring to FIGS. 1A, 1B, 2, and 6, the timer 10 of the present invention also includes a delay no-back pawl 21 which prevents the delay wheel 18 from being turned backwards when the timer 10 is in either in-cycle delay advancement or delay to start advancement. The delay no-back pawl 21 is pivotally fixed in the housing. The delay no-back pawl 21 also includes a ball arm 25 which extends away from the lever arm 57 of the delay no-back pawl 21, as depicted in the illustrated embodiment. The ball arm 25 cooperates with and confronts a surface (not shown) of the housing (not shown) of the timer 10. The ball arm 25 rests against and flexes against this surface to maintain pressure on the delay no-back pawl, as the delay wheel 18 is rotated.

In use, when the delay pawl 22 completes a stroke advancing the delay wheel 18, the delay no-back pawl 21 drops into engagement with a tooth 74. As the delay pawl 22 oscillates back to prepare to advance another tooth 74 of the delay wheel 18, the delay no-back pawl 21 abuts an edge 93 of a tooth 74, preventing the delay wheel 18 from rotating backwards with the delay pawl 22. The delay no-back pawl 21 is kept in engagement with that tooth 74 by the pressure from the ball arm 25 which abuts the timer housing (not shown). As the delay pawl 22 advances the delay wheel 18, the delay no-back pawl 21 rides up the slope of the tooth 74 and drops into engagement with the next tooth at the completion of the advance stroke.

Figure 6:
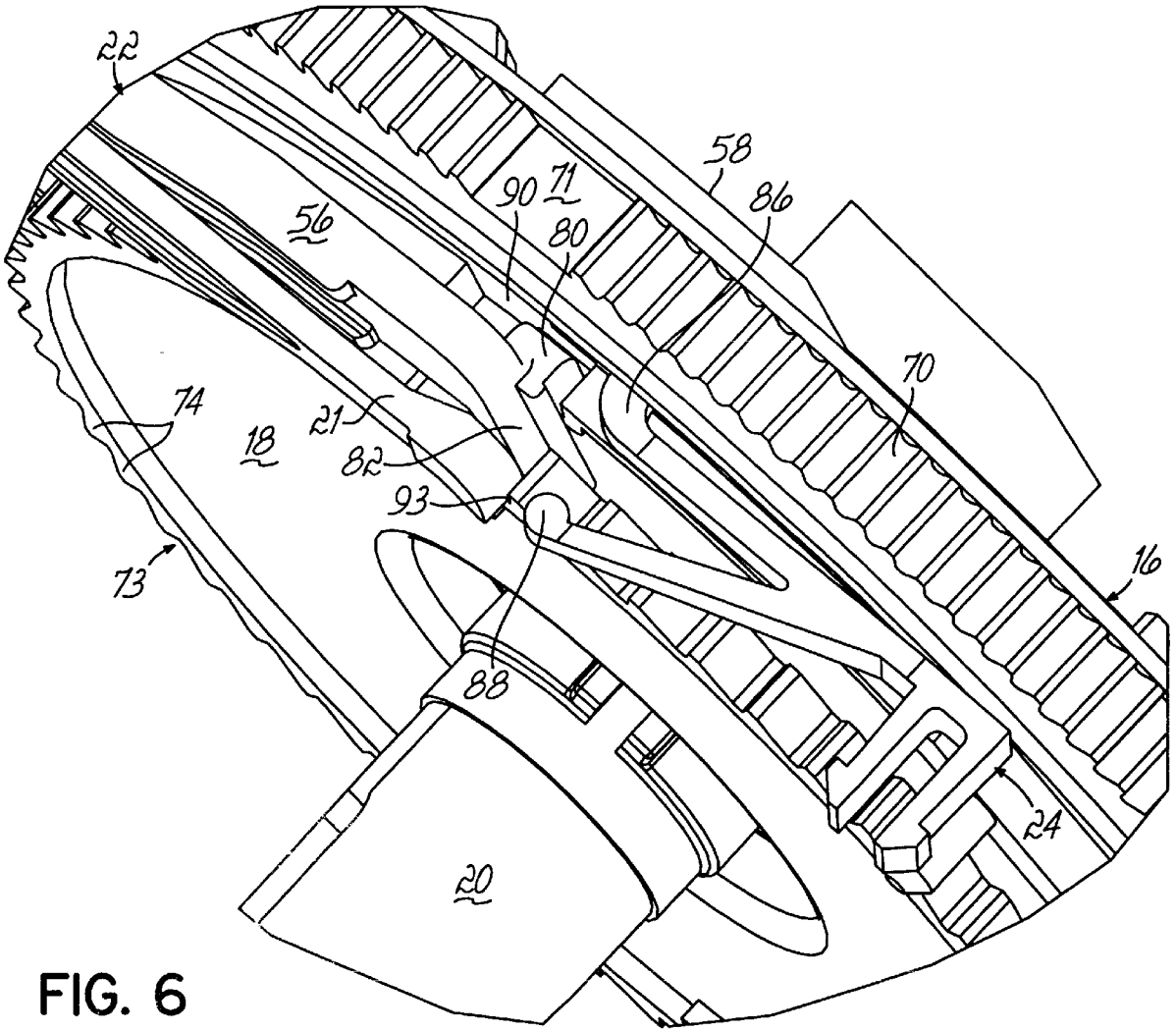
FIG. 6 is a perspective view of the no-back pawl of the timer of the present invention.

Referring to FIGS. 1A, 2, and 6, the timer 10 of the present invention also includes a cam no-back pawl 24 which prevents the rotatable cam-carrying member 16 from being turned backwards when the timer 10 is in either in-cycle delay advancement or delay-to-start advancement. The cam no-back pawl 24 is journalled to a fixed location on the timer 10 housing (not shown) and includes a hook arm 86 and a ball arm 88. The hook arm 86 cooperates with and confronts a surface 90 of the rotatable cam-carrying member 16. The ball arm 88 rests against a wall of the timer using (not shown) and flexes against the wall to maintain pressure on the hook arm 86 as the cam-carrying member 16 is rotated. The hook arm 86 flexes against the surface of the rotatable cam-carrying member 16 as it is rotated.

The surface 90 of the rotatable cam-carrying member 16 that is confronted by the hook arm 86 of the cam no-back pawl 24 includes a plurality of notches 92 disposed intermittently about the surface 90. As the rotatable cam-carrying member 16 progresses from normal constant speed drive to a delay mode, the geartrain 12 is disengaged and the delay pawl 22 drives rotation of the cam-carrying member 16. As this occurs, the hook arm 86 of the no-back pawl 24 confronts a notch 92 on the rotatable cam-carrying member 16. As forward rotation of the cam-carrying member 16 proceeds, the hook arm 86 ramps up and out of one notch 92 and snaps into the next succeeding notch 92. However, if any reverse rotation of the rotatable cam-carrying member 16 is attempted, the distal end of the hook arm 86 abuts an inner wall 91 of the notch 92, thus preventing any such reverse rotation. As the timer 10 progresses out of delay mode, the hook arm 86 ramps out of a notch 92 and returns to riding against the surface 90 of the rotatable cam-carrying member 16. At this point, the geartrain 12 once again takes over the drive mechanism of the rotatable cam-carrying member 16 and reverse rotation of the cam-carrying member 16 is prevented by the clutch 14.

Referring to FIGS. 1A, 1B, 2, and 7, when the pinion teeth 46 of the final output pinion 44 are engaged with the gear teeth 70 on the rotatable cam-carrying member 16, the clutch 14 prevents reverse rotation of the rotatable cam-carrying member 16. The clutch 14 is in the form of a first rotating member 94 and a second rotating member 96 that are included in the geartrain 12 of the drive mechanism between the timing motor (not shown) and rotatable cam-carrying member 16. The first and second rotating members 94, 96 of the clutch 14 each include a plurality of protrusions about their surface. When the first and second rotating members 94, 96 are axially aligned, the protrusions of the first rotating member 94 mesh with the protrusions of the second rotating member 96 so as to engage the second rotating member 96 and force forward rotation of the second rotating member 96 upon forward rotation of the first rotating member 94, and prevent reverse rotation of second rotating member 96 upon reverse rotation of the rotatable cam-carrying member 16, but permit slip between the second rotating member 96 and first rotating member 94 upon forward rotation of the rotatable cam-carrying member 16. More specifically, the first rotating member 94 has a plurality of clutch teeth 98 positioned about an inside periphery thereof, and the second rotating member 96 has a plurality of clutch prongs 100 sized to engage the clutch teeth 98. The first rotating member 94 is annular and defines an orifice 101 about its axis of symmetry. The second rotating member 96 is placed through the orifice 101 so that the clutch prongs 100 of the second rotating member 96 can be axially aligned with the clutch teeth 98 of the first rotating member 94.

However, in either delay mode, the geartrain 12 is disengaged from the rotatable cam-carrying member 16. Thus, the no-back pawl 24 again engages with notches 92 in the surface 90 of the rotatable cam-carrying member 16 to prevent reverse rotation of the rotatable cam-carrying member 16.

Figure 8:
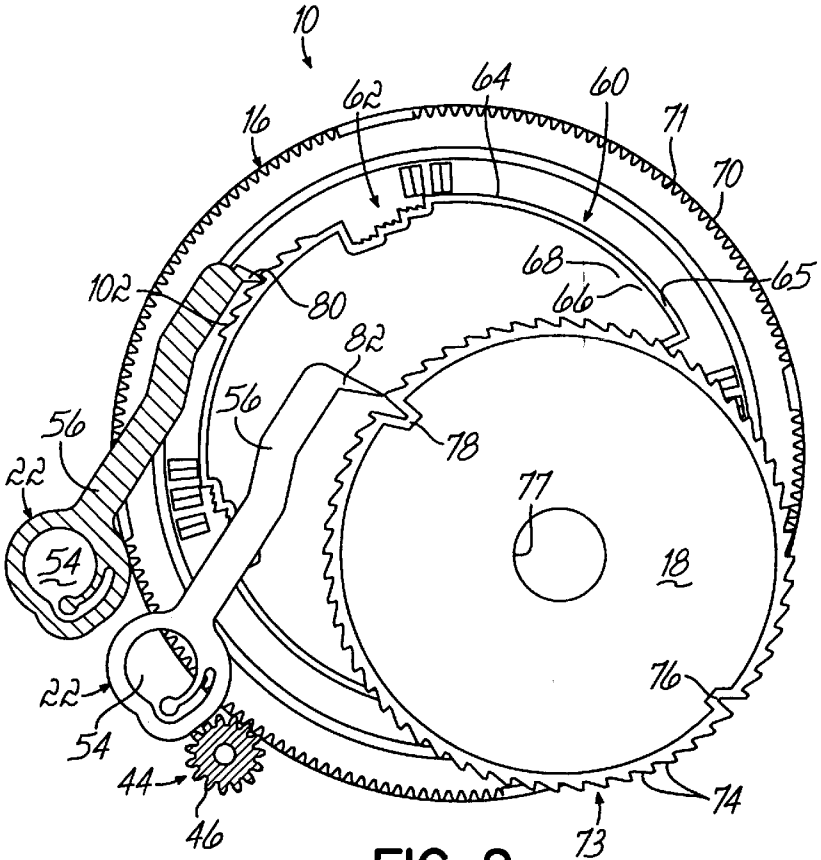
FIG. 8 is a perspective view of an alternate embodiment of the timer of the present invention, depicting the first prong engaging upper level ratchet teeth on the control profile of the cam-carrying member.

When used with the constant speed program drive system, an alternate embodiment of the timer 10 of the present invention provides for rapid advance of the rotatable cam-carrying member 16. Referring to FIG. 8, in this embodiment, the plateaus 64 of the top radius on the control profile 60 are replaced with upper level teeth 102, permitting the program cam to be advanced at an accelerated rate. A pinion (not shown in FIG. 8) of the geartrain 12 is disposed through the orifice 54 at the distal end of the lever arm 56 of the delay pawl 22. As the pinion rotates, the pinion teeth drive oscillation of the delay pawl 22. The first prong 80 of the delay paw 22 engages one upper level tooth 102 on the control profile 60 with each oscillation of the delay pawl 22, resulting in non-delay rotation of the rotatable cam-carrying member 16.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

What is claimed is:

1. A timer for controlling an appliance, comprising:

a rotatable cam-carrying member having cam surfaces thereon, and further including a control profile having a plurality of teeth and a plurality of plateaus disposed thereon;

a rotatable delay wheel having a plurality of delay teeth disposed about the periphery of said delay wheel, each of said delay teeth being spaced a substantially equal distance one from another, and said delay teeth having a depth which is a substantially uniform depth relative to one another, at least two of said delay teeth being of greater depth than the substantially uniform depth of the remaining delay teeth;

a shaft to which said cam-carrying member is fixedly mounted and about which said delay wheel is freely rotatable, said cam-carrying member and said delay wheel being located adjacent one another;

a drive mechanism for directly causing rotation of said cam-carrying member; and a delay pawl operatively connected to said drive mechanism, said delay pawl including first and second prongs, wherein said first prong is adapted to contact said cam-carrying member and said second prong is adapted to contact said delay wheel.

2. The timer of claim 1 wherein said plurality of teeth on said control profile include intermediate teeth and low teeth, said low teeth being disposed on said control profile radially inwardly of said intermediate teeth.

3. The timer of claim 2 wherein said intermediate teeth are disposed on said control profile radially inwardly of said plurality of plateaus.

4. The timer of claim 3 wherein said delay teeth include upper delay teeth, at least one intermediate delay tooth, and at least one deep delay tooth, wherein said upper delay teeth exhibit a substantially uniform depth, said at least one intermediate delay tooth has a depth greater than the depth of said upper delay teeth, and said at least one deep delay tooth has a depth greater than the depth of said at least one intermediate delay tooth.

5. The timer of claim 4 wherein said first prong is adapted to contact said plurality of teeth and plurality of plateaus of said control profile and said second prong is adapted to contact said delay teeth.

6. The timer of claim 5 wherein when said first prong contacts one of said plurality of plateaus, said second prong does not contact said delay teeth.

7. The timer of claim 5 wherein when said second prong contacts said upper delay teeth, said first prong does not contact said control profile.

8. The timer of claim 5 wherein when said second prong contacts said at least one intermediate delay tooth, said first prong contacts said intermediate teeth.

9. The timer of claim 5 wherein when said second prong contacts said at least one low delay tooth, said first prong contacts said intermediate teeth.

10. The timer of claim 5 wherein when said second prong contacts said at least one intermediate delay tooth, said first prong does not contact said control profile.

11. The timer of claim 5 wherein when said second prong contacts said at least one low delay tooth, said first prong contacts said low teeth.

12. The timer of claim 1 wherein said drive mechanism further includes a geartrain having a plurality of gears and a plurality of pinions.

13. The timer of claim 12 wherein when said second prong contacts said delay wheel, said geartrain is disengaged from said rotatable cam-carrying member.

14. The timer of claim 12 wherein said geartrain further includes a clutch to prevent reverse rotation of said rotatable cam-carrying member when said geartrain is engaged to said rotatable cam-carrying member.

15. The timer of claim 14 wherein said clutch further includes first and second rotating clutch members each having a plurality of protrusions about their surface.

16. The timer of claim 15 wherein the protrusions of the first rotating clutch member force forward rotation of the second rotating clutch member upon forward rotation of the first rotating clutch member, and the protrusions of the first rotating clutch member permit slip between the second rotating clutch member and first rotating clutch member upon forward rotation of the rotatable cam-carrying member, but the protrusions of the first rotating clutch member prevent reverse rotation of the rotatable cam-carrying member.

17. The timer of claim 12, further including a delay no-back pawl having a prong and a ball arm to prevent reverse rotation of said delay wheel.

18. The timer of claim 17, wherein said prong is adapted to engage one of said plurality of delay teeth.

19. The timer of claim 12, further including a cam no-back pawl having a hook arm and a ball arm to prevent reverse rotation of said rotatable cam-carrying member when said geartrain is disengaged from said rotatable cam-carrying member.

20. The timer of claim 19 wherein said rotatable cam-carrying member further includes a plurality of notches disposed on a surface thereof.

21. The timer of claim 20 wherein said hook arm is adapted to engage at least one of said notches when said second prong engages one of said plurality of delay teeth to complete advancement of the cam.

22. The timer of claim 2 wherein said control profile further includes a plurality of upper teeth disposed on said control profile, said upper teeth being disposed on said control profile radially outwardly of said plateaus.

23. The timer of claim 22 wherein when said first prong contacts said upper teeth, said second prong does not contact any delay teeth.

24. A timer for controlling an appliance, comprising:

a rotatable cam-carrying member having cam surfaces thereon, and further including a control profile having a plurality of teeth and a plurality of plateaus disposed thereon;

a rotatable delay wheel having a plurality of delay teeth disposed about the periphery of said delay wheel, each of said delay teeth being spaced a substantially equal distance one from another, and said delay teeth having a depth which is a substantially uniform depth relative to one another, at least two of said delay teeth being of greater depth than the substantially uniform depth of the remaining delay teeth;

a shaft to which said cam-carrying member is fixedly mounted and about which said delay wheel is freely rotatable, said cam-carrying member and said delay wheel being located adjacent one another;

a first drive mechanism for causing rotation of said cam carrying member when said timer is in a normal advance mode; and a second drive mechanism for causing rotation of said cam carrying member when said timer is in a delay mode.

25. The timer of claim 24 wherein said first drive mechanism includes a geartrain having a plurality of gears and a plurality of pinions, said geartrain being operatively connected to said rotatable cam-carrying member.

26. The timer of claim 25 wherein said second drive mechanism includes a delay pawl adapted to contact and cause rotation of said delay wheel, thereby causing rotation of said rotatable cam-carrying member.

27. The timer of claim 26 wherein said first drive mechanism is disengaged when said second drive mechanism is engaged.

28. The timer of claim 27 wherein said delay pawl of said second drive mechanism is operatively connected to said geartrain of said first drive mechanism.

29. A timer for controlling an appliance, comprising:

a rotatable cam-carrying member having cam surfaces thereon, and further including a control profile having a plurality of teeth and a plurality of plateaus disposed thereon, said plurality of teeth further including a plurality of upper teeth disposed on said control profile the same radial distance from the axis of symmetry of the rotatable cam-carrying member as the plurality of plateaus;

a rotatable delay wheel having a plurality of delay teeth disposed about the periphery of said delay wheel, each of said delay teeth being spaced a substantially equal distance one from another, and said delay teeth having a depth which is a substantially uniform depth relative to one another, at least two of said delay teeth being of greater depth than the substantially uniform depth of the remaining delay teeth;

a shaft to which said cam-carrying member is fixedly mounted and about which said delay wheel is freely rotatable, said cam-carrying member and said delay wheel being located adjacent one another; and a drive mechanism including a delay pawl, said delay pawl including first and second prongs, wherein said first prong is adapted to contact said cam-carrying member and said second prong is adapted to contact said delay wheel.

30. The timer of claim 29 wherein when said first prong contacts said upper teeth, said second prong does not contact any delay teeth.

* * * * *

UNITED STATES PATENT AND TRADEMARK OFFICE

CERTIFICATE OF CORRECTION

PATENT NO. : 6,583,372 B1
DATED : June 24, 2003
INVENTOR(S) : Daniel K. Amonett

It is certified that error appears in the above-identified patent and that said Letters Patent is hereby corrected as shown below:

Column 3,
Line 61, “paw” should be -- pawl --.

Column 11,
Line 23, “using” should be -- housing --.

Column 12,
Line 30, “paw” should be -- pawl --.

Column 14,
Lines 32 through 33, “cam carrying” should be -- cam-carrying --.
Line 36, “cam carrying” should be -- cam-carrying --.

Signed and Sealed this

Sixteenth Day of December, 2003

JAMES E. ROGAN
*Director of the United States Patent and Trademark Office*